United States Patent [19]

Baldasarri et al.

[11] Patent Number: 4,707,245

[45] Date of Patent: Nov. 17, 1987

[54] TEMPERATURE CONTROL FOR HYDROGENATION REACTIONS

[75] Inventors: Mario Baldasarri, Paramus; William R. Adams, Upper Montclair; John Caspers, Basking Ridge, all of N.J.

[73] Assignee: Lummus Crest, Inc., Bloomfield, N.J.

[21] Appl. No.: 811,488

[22] Filed: Dec. 20, 1985

[51] Int. Cl.[4] ..... C10G 45/00; C10G 65/02

[52] U.S. Cl. ..... 208/57; 208/DIG. 1; 208/59; 208/143

[58] Field of Search ..... 208/57, 58, 59, DIG. 1, 208/46; 422/110, 111

[56] References Cited

U.S. PATENT DOCUMENTS

| | | | |
|---|---|---|---|
| 3,402,121 | 9/1968 | Hallman | 208/59 |
| 3,607,091 | 9/1971 | Boyd | 208/59 |
| 3,656,911 | 4/1972 | Hobbs | 208/DIG. 1 |
| 3,974,064 | 8/1976 | Bajer et al. | 208/DIG. 1 |
| 3,974,065 | 8/1976 | Powell et al. | 208/59 |
| 3,981,793 | 9/1976 | Christie et al. | 208/DIG. 1 |
| 4,132,529 | 1/1979 | Schwimmer | 208/DIG. 1 |
| 4,234,410 | 11/1980 | Kelley | 208/57 |
| 4,236,219 | 11/1980 | Killebrew, Jr. et al. | 208/DIG. 1 |
| 4,491,924 | 1/1985 | Agarwal | 422/110 |
| 4,617,110 | 10/1986 | Hinojos et al. | 208/DIG. 1 |

*Primary Examiner*—Andrew H. Metz
*Assistant Examiner*—Anthony McFarlane
*Attorney, Agent, or Firm*—Elliot M. Olstein

[57] ABSTRACT

Temperature is controlled in a hydrogenation reactor without changing the flow rate of feed into the reactor to maintain a pre-determined temperature in the reactor. In one embodiment, the firing rate of a fuel fired furnace for heating feed to the reactor is controlled in response to the temperature sensed in the reactor to maintain a pre-determined temperature. In another embodiment, the flow rate of a quenching stream for cooling feed to the reactor is controlled in response to temperature sensed in the reactor to maintain a pre-determined temperature in the reactor.

15 Claims, 1 Drawing Figure

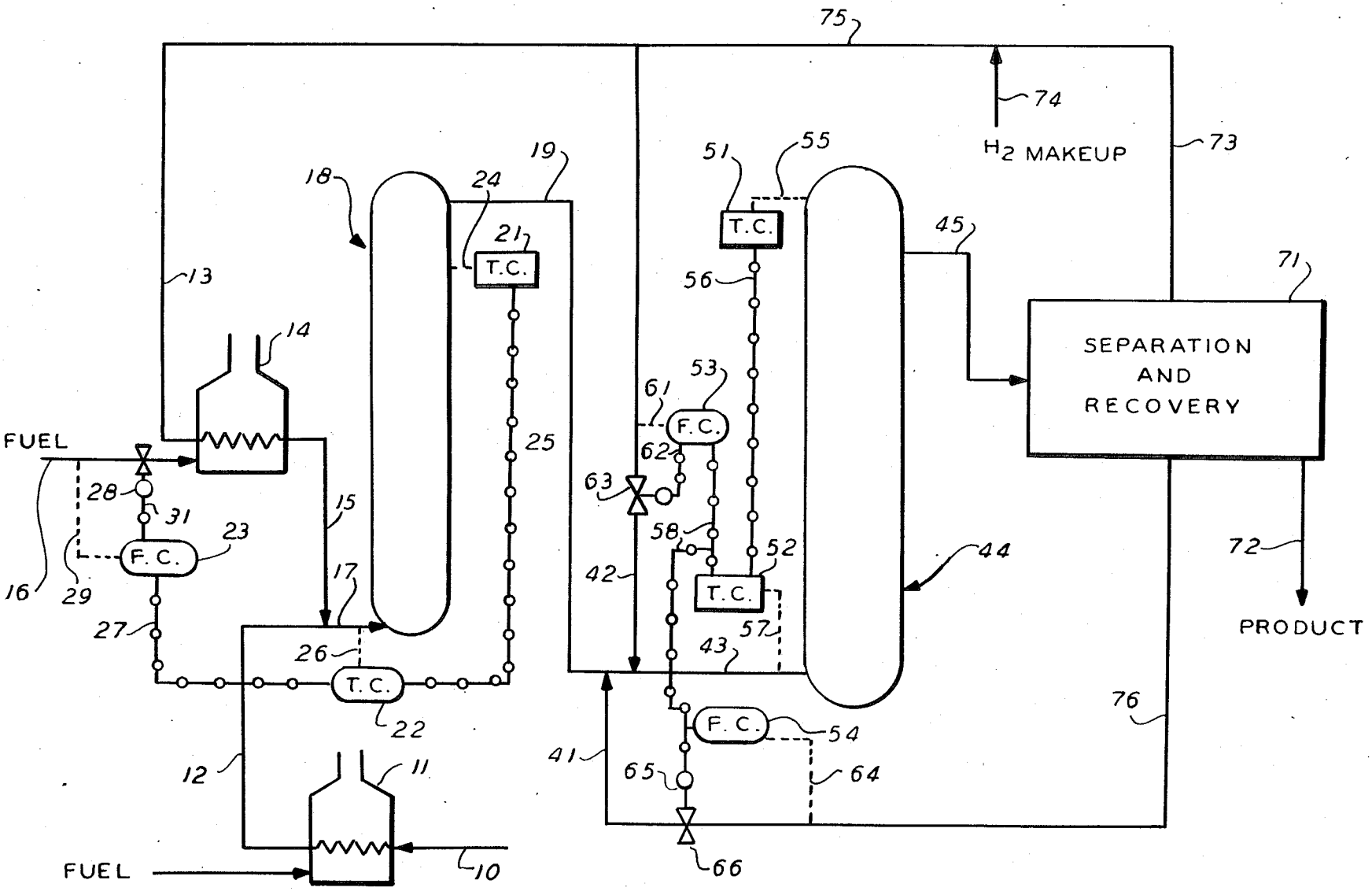
SEPARATION AND RECOVERY
PRODUCT
$H_2$ MAKEUP
FUEL
FUEL
T.C.
F.C.
10
11
12
13
14
15
16
17
18
19
21
22
23
24
25
26
27
28
29
31
41
42
43
44
45
51
52
53
54
55
56
57
58
61
62
63
64
65
66
71
72
73
74
75
76

TEMPERATURE CONTROL FOR HYDROGENATION REACTIONS

This invention relates to hydrogenation, and more particularly to temperature control in a hydrogenation process.

Hydrocarbon materials from both petroleum and coal sources are often upgraded by a hydrogenation process. In such a hydrogenation process, a material to be upgraded is contacted with hydrogen in the presence of a suitable hydrogenation catalyst.

In one type of such process, there is employed an expanded bed of catalyst. Often, in such processes, there are at least two reactors in the series.

In such a process, it is necessary to control the temperature in the reactor so as to obtain desired conversions and/or selectivities.

The present invention is directed to providing for improved temperature control in such reactors.

In accordance with one aspect of the present invention, in a hydrogenation process wherein one or more components of the feed is heated in a fuel fired heater, reaction temperature is controlled by controlling the rate of flow of fuel to the fired heater in response to the temperature in the reactor so as to maintain a pre-determined temperature value in the reactor.

More particularly, in a hydrogenation process, both feed to be upgraded and a gas containing hydrogen are heated prior to introduction into a hydrogenation reactor. In most cases, there is provided a separate heater for each of the gas containing hydrogen and the feed to be upgraded, although, in some cases, both the hydrogen gas and the feed may be heated in a single heater. In accordance with a preferred embodiment of this aspect of the present invention, the rate of flow of fuel to the heater for heating the hydrogen gas is controlled so as to maintain a pre-determined temperature value in the hydrogenation reactor. It is to be understood, however, that the fuel flow to the feed heater may be controlled in order to maintain a pre-determined temperature value in the hydrogenation reactor; however, such an embodiment is less preferred.

In accordance with a preferred embodiment of this aspect of the present invention, there is provided a first temperature controller which receives a first signal responsive to the temperature in the hydrogenation reactor. The temperature controller compares the first signal with a setpoint for the first temperature controller which corresponds to the pre-determined temperature value for the hydrogenation reactor, and generates a second signal which is responsive to a comparison between the first signal and the setpoint for the first temperature controller. A second temperature controller receives the second signal, and the setpoint of the second temperature controller is changed in response to the second signal. The second temperature controller receives a third signal which is responsive to the temperature of a combined feed (hydrogen gas and material to be upgraded) which is to be introduced into the hydrogenation reactor. The second temperature controller produces a fourth signal which is responsive to a comparison between the temperature of the combined feed to the hydrognation reactor and the setpoint of the second controller, which has been set by the second signal from the first temperature controller. The fourth signal from the second temperature controller controls the flow rate of fuel to the heater for heating the hydrogen gas for the hydrogenation reactor; in particular, by changing the setpoint of a flow controller for the fuel.

In this manner, the temperature of the hydrogenation reactor is controlled by controlling the flow rate of fuel to the heater for heating the hydrogen gas, rather than by controlling the flow rate of either of the feed components (hydrogen gas or feed to be upgraded) to the hydrogenation reactor.

In accordance with another aspect of the present invention, there is provided a process and system for controlling temperature in a hydrogenation reactor which employs as feed, an effluent from a previous hydrogenation reactor and wherein the effluent from the previous reactor to be used as feed is quenched by a quenching stream, which quenching stream may be either a gas stream or a liquid stream, or both a gas and a liquid stream.

More particularly, in accordance with this further aspect of the present invention, the effluent from a previous hydrogenation reactor, which is to be employed as feed to a hydrogenation reactor, is combined with a quench stream, and the flow rate of the quench stream is controlled in response to the temperature in the hydrogenation reactor so as to maintain a pre-determined temperature value in the hydrogenation reactor.

Still more particularly, in accordance with this further aspect of the present invention, there is provided a first temperature controller which receives a first signal representative of the temperature in the hydrogenation reactor. The first temperature controller generates a second signal which is responsive to a comparison between the first signal and a setpoint for the first temperature controller which corresponds to a pre-determined temperature value for the hydrogenation reactor. The second signal changes the setpoint of a second temperature controller, which also receives a third signal, which corresponds to the temperature of the combined feed and quench stream to be introduced into the hydrogenation reactor. The second temperature controller provides a fourth signal, which is responsive to a comparison between the third signal and the setpoint of the second temperature controller, as controlled by the second signal, and the flow rate of the quench stream is controlled in response to the fourth signal so as to maintain a pre-determined temperature value in the hydrogenation reactor; in particular, by changing the setpoint of a flow controller for the quench stream.

In accordance with a particularly preferred embodiment of this aspect of the present invention, the feed to a hydrogenation reactor, which is derived from an effluent from a previous hydrogenation reactor, is quenched with both a gas stream and a liquid stream, with at least one of the flow rate of the gas and liquid stream being controlled so as to maintain a pre-determined temperature in the hydrogenation reactor. The gas quench stream is a gas containing hydrogen for introduction into the hydrogenation reactor.

The term "pre-determined or pre-set temperature value", when used herein, is not limited to a single temperature value, in that the temperature value can be values within a predetermined temperature range. Accordingly, the term "temperature value" refers both to a single temperature and a predetermined or defined range of temperature.

Although the process of the present invention is applicable to any one of a wide variety of hydrogenation processes, the process has particular applicability to a process for the upgrading of high boiling hydrocarbon materials (derived from either petroleum or coal sources) by hydrogenation in an expanded bed catalytic hydrogenation zone of a type known in the art. Thus, as known in the art, such hydrogenation is effected by use of an expanded catalyst bed at temperatures in the order of from about 650° F. to 900+ F. and at operating pressures in the order of from 500 psig to 4000 psig. The catalyst which is employed is generally one of a wide variety of catalysts which are known to be effective for hydrogenation of high boiling materials, and as representative examples of such catalysts, there may be mentioned cobalt-molybdate, nickel-molybdate, cobalt-nickel-molybdate, tungsten-nickel-sulfide, tungsten sulfide, etc., with such catalysts generally being supported on a suitable support such as alumina or silica-alumina.

In general, the feed to such a process is one which has high boiling components which can be converted to more valuable low boiling components. In general, such a hydrocarbon feed has at least 25%, by volume, of material boiling above 950° F. Such feed may be derived from either petroleum and/or coal sources, with the feed generally being a petroleum residuum, such as atmospheric tower bottoms, vacuum tower bottoms, heavy crudes and tars containing small amounts of material boiling below 650° F., or solvent refined coal, etc. The selection of a suitable feedstock is deemed to be within the scope of those skilled in the art, and as a result, no further details in this respect are deemed necessary for a complete understanding of the present invention.

BRIEF DESCRIPTION OF THE DRAWING

The invention will be further described with respect to the accompanying drawing, wherein:

The drawing is a simplified schematic flow diagram of a hydrogenation process incorporating various aspects of the present invention.

Referring now to the drawing, a feed to be upgraded in line 10 is heated in a fuel fired heater 11, and the heated feed is withdrawn from the heater 11 through line 12. The fuel flow to heater 11 may be controlled in response to the effluent temperature in line 12.

A gas containing hydrogen in line 13, which as hereinafter indicated, is comprised of both makeup hydrogen and recycle hydrogen, which also may include a diluent, such as methane, is introduced into a fuel fired heater 14 and the heated gas is withdrawn from heater 14 through line 15. Fuel is provided to heater 14 through line 16.

The heated gas in line 15 and the heated feed to be upgraded in line 12 are combined in line 17 and introduced into a hydrogenation reactor 18, which is preferably an expanded bed hydrogenation reactor of a type known in the art. An upgraded effluent, which also includes unreacted hydrogen gas, is withdrawn from reactor 18 through line 19.

Temperature is maintained in reactor 18 by a temperature control in accordance with one aspect of the present invention, which includes a first temperature controller 21, a second temperature controller 22 and a flow controller 23.

The temperature controller 21 receives a signal 24 which is representative of the temperature in reactor 18. Such signal 24 may be generated by placing one or more thermocouples in reactor 18. As known in the art, reactor 18 includes an expanded bed of hydrogenation catalyst, and such thermocouples may be provided by the use of appropriate thermocouple wells in reactor 18.

In accordance with a particularly preferred embodiment, there is provided a plurality of thermocouples at different height levels in the reactor 18, and the signal 24 is provided by averaging the temperatures sensed by a plurality of thermocouples, at various levels in the catalyst bed in reactor 18. Thus, in effect, the signal 24 provided to temperature controller 21 is representative of an average temperature in reactor 18. It is to be understood that the temperature may be determined other than by an average; e.g. by use of a thermocouple reporting the highest temperature.

The temperature controller 21 has a setpoint which is representative of the pre-determined temperature value which is to be maintained in reactor 18.

The temperature controller 21 compares the signal 24 with the setpoint for the temperature controller 21 which is representative of the pre-determined temperature value, and generates a signal 25 representative of the comparison between signal 24 and the setpoint of temperature controller 21, which signal 25 is provided to temperature controller 22.

The signal 25 functions to change the setpoint of temperature controller 22, which temperature controller 22 controls the temperature of the combined feed introduced into reactor 18 through line 17. Thus, if the signal 24 indicates that the temperature in the reactor is below the pre-determined temperature value for the reactor (setpoint of controller 21), then signal 25 functions to raise the temperature setpoint for temperature controller 22. If signal 24 indicates that the temperature in reactor 18 is above the setpoint for temperature controller 21, then signal 25 functions to decrease the setpoint for temperature controller 22.

Temperature controller 22 receives a signal 26 responsive to the temperature of the combined feed in line 17, and temperature controller 22 compares signal 26 with the setpoint of controller 22, which has been set by signal 25 to generate a signal 27 which is representative of the comparison between signal 26 and the setpoint of temperature controller 22. The signal 27 from temperature controller 22 is received by flow controller 23, and signal 27 functions to control the setpoint of the flow controller 23. The flow controller 23 controls the flow of fuel to heater 14 through line 16 by a suitable flow control means, such as a valve 28.

If signal 26 received by temperature controller 22 indicates that the temperature in line 17 is above the setpoint for controller 22 (as set by signal 25), then signal 27 resets the setpoint for controller 23 so as to provide for a decreased flow of fuel through line 16. If signal 27 indicates that the temperature in line 17 is below the setpoint for temperature controller 22 (as set by signal 25), then signal 27 from temperature controller 22 to flow controller 23 functions to increase the setpoint of flow controller 23 so as to increase the flow of fuel to heater 14 through line 16. The flow controller 23 receives a signal 29 which is indicative of the flow through line 16, and provides a signal 31 to valve 28 to maintain a flow rate through line 16 which corresponds to the setpoint of flow controller 23 (as controlled by signal 27).

In this manner, the temperature of reactor 18 is controlled by controlling the rate of flow of fuel to heater 14 which heats the gaseous hydrogen to be introduced into reactor 18. Thus, as should be apparent, if the temperature in reactor 18 increases above the pre-determined value, the flow of fuel through line 16 is reduced to reduce the temperature of the hydrogen gas in line 15, which reduces the temperature of the combined feed in line 17, which in turn reduces the temperature in reactor 18. Conversely, if the temperature in reactor 18 is below the pre-determined value, the flow of fuel through line 16 is increased, which increases the temperature of the hydrogen gas in line 15, thereby increasing the temperature of the combined stream in line 17, which in turn increases the temperature in reactor 18.

Although the embodiment has been particularly described with reference to controlling the flow rate of fuel to the hydrogen heater, it is to be understood that in some cases, it may be possible to also achieve temperature control by controlling the flow rate of fuel to heater 11 which heats the feed to be upgraded. Similarly, in some cases, it may be possible to provide a single heater for heating both the hydrogen gas and the fuel, and in such a case, the flow of fuel to such a heater would be controlled as hereinabove described.

It is to be understood that the heaters may be fired by either gas or oil.

Referring back to the effluent from hydrogenation reactor 18, in line 19, such effluent in line 19 is combined with a quench liquid in line 41 and a quench gas, in line 42, which quench gas is a gas containing hydrogen, which functions to both quench the effluent in line 19 and to provide additional hydrogen, and the combined stream in line 43 is introduced into the second hydrogenation reactor, generally designated as 44, which is similar to reactor 18. Thus, reactor 44 contains an expanded bed of hydrogenation catalyst, and an effluent is withdrawn therefrom for introduction into a separation and recovery zone.

The temperature in reactor 44 is controlled in accordance with a further aspect of the present invention. As shown, there is provided a first temperature controller 51, a second temperature controller 52, a flow controller 53 for the hydrogen quench gas, and a flow controller 54 for the liquid quench.

The temperature controller 51 functions in a manner similar to temperature controller 21, and the temperature controller 52 functions in a manner similar to temperature controller 22. Thus, temperature controller 51 receives a signal 55 which corresponds to the temperature in reactor 44, and signal 55 may be generated in a manner similar to signal 24. The temperature controller 51 generates a signal 56, based on a comparison between signal 55 and the setpoint for temperature controller 51. In this manner, signal 56 is similar to signal 25 from temperature controller 21.

The signal 56 controls the setpoint of temperature controller 52 in a manner similar to the manner in which the setpoint of temperature controller 22 is controlled by signal 25.

The temperature controller 52 receives a signal 57 which is indicative of the temperature of the combined feed in line 43. Temperature controller 52 generates a signal 58 which is representative of a comparison between the temperature detected by signal 57 and the setpoint of temperature controller 52, as set by signal 56. The signal 58 from temperature controller 52 is received by the flow controller 53 and/or flow controller 54, depending on the manner in which the respective gas and liquid quenches are employed for maintaining the temperature of reactor 44, as hereinafter described.

The signal 58 functions to reset the setpoint of flow controller 53 and/or flow controller 54 in a manner similar to that in which signal 27 controls the setpoint of flow controller 23.

Flow controller 53 receives a signal 61 which is indicative of the flow of hydrogen containing gas through line 42, and flow controller 53 generates a signal 62 which controls a suitable flow control means, such as a valve 63 in line 42. Thus, signal 62 functions to increase or decrease the flow depending on whether or not signal 61 indicates that the flow in line 42 is below or above the setpoint for flow controller 53, which setpoint is controlled by signal 58.

Similarly, flow controller 54 receives a signal 64 which is indicative of the flow rate in line 41, and generates a signal 65 which controls a suitable flow regulator, such as a valve 66, in line 41. The signal 65 increases or decreases flow through line 41 depending on whether signal 64 indicates that the flow in line 41 is below or above the setpoint of flow controller 54, which setpoint of controller 54 is controlled by signal 58.

As should be apparent, the rate of flow of the quench stream and/or streams, which may be either the gas in line 42 and/or the liquid in line 41, check is controlled in response to the temperature in reactor 44 so as to maintain a predetermined temperature value in reactor 44.

In other words, if the temperature in reactor 44 is above the pre-determined temperature value, then signal 56 resets the setpoint of temperature controller 52 to a lower temperature to decrease the temperature in reactor 44 by setting a lower temperature for the combined feed introduced into reactor 44 through line 43.

Correspondingly, the newly set setpoint for temperature controller 52 (the temperature to be maintained in line 43) is maintained by controlling the flow of the gas and/or liquid quench in lines 42 and 41, respectively. This is accomplished by changing the setpoint of the flow controller 53 and/or 54 so as to increase the flow through lines 41 and/or 41, respectively, in response to the difference between the temperature indicated by signal 57 and the setpoint of temperature controller 52. If the temperature indicated by signal 57 is above the setpoint of controller 52, then signal 58 functions to increase the flow rate setpoint of the flow controller 53 and/or 54 so as to increase the flow of quenching gas and/or quenching liquid through lines 42 and/or 41, respectively, which reduces the temperature of the combined stream in line 43.

The overall operation in the case where the temperature in reactor 44 is lower than the pre-determined value is similarly effected, except that various controls function to decrease the flow rate of gas and/or liquid through lines 42 and/or 41, respectively.

In actual operation, the flow rate of the gas through line 42 may be fixed, and the flow rate of the liquid quench through line 41 may be varied by use of the hereinabove described control scheme. Alternatively, the flow rate of the liquid quench through line 41 may be fixed, and the flow rate of the gas quench through line 42 may be varied in accordance with the hereinabove control scheme. As a further alternative, both the liquid and gas quenches in line 42 and 41, respectively, may be operated under control of the hereinabove described control system.

In accordance with a preferred embodiment wherein reactor 44 is an expanded bed reactor, in the case where both a liquid and a gas quench are required for maintaining reaction temperature, it is preferred to fix or baseload the flow of the quench gas into the reactor, and to vary the flow rate of the liquid quench so as to control temperature in that a constant baseloading of the flow of gas to the reactor stabilizes the expansion of the catalyst bed in the reactor.

It is to be understood that in some cases the use of a quench liquid may be totally eliminated in that the flow of hydrogen gas required for introduction into the second reactor is sufficient to control temperature for the second reactor. In such a case, the gas stream is controlled as hereinabove described, and there is no flow of quench liquid.

In many cases, however, it is necessary to provide for quenching by use of both gas and liquid, and in such cases, as hereinabove described, it is preferred to set the gas quench at a constant baseload, and vary the liquid quench in accordance with the control scheme. It is to be understood, however, that in the case where both liquid and gas quench are employed, it is possible to constant baseload the liquid and vary the gas, or to vary both the liquid and gas quench.

Referring back to the effluent recovered through line 45 from reactor 44, such effluent is introduced into a separation and recovery zone, schematically generally indicated as 71. In the separation and recovery zone 71, there is recovered product through line 72, and a hydrogen recycle gas through line 73. Such hydrogen recycle gas in line 73 is combined with makeup gas in line 74, and the combined stream in line 75 is used in lines 13 and 42, as hereinabove described. As an alternative, the quench gas may be either fresh feed hydrogen or recycle hydrogen. In addition, in the case where a quench liquid is used, such quench liquid is recovered from the separation and recovery zone 71 through line 76 for use in line 41, as hereinabove described.

It is to be understood that in most cases where such a quench liquid is employed for use in an expanded bed hydrogenation system, such quench liquid is derived from the reaction product, and most generally has a boiling range which falls within the temperature of from about 200°–500° F. It is to be understood, however, that the present scheme is not limited to such a quench liquid.

Although the embodiment has been particularly described with reference to controlling the temperature in the first reactor and in the second reactor in accordance with control schemes of the present invention, it is to be understood that the present invention is not limited to using such control schemes in such a combination. Thus, for example, even if two reactors are employed, it is possible to employ the control scheme hereinabove described for the first reactor, without employing the control scheme hereinabove described for the second reactor and vice-versa.

Similarly, although the embodiment has been described with respect to using two reactors in series, it is possible to use more than two reactors in series, and in such a case, if there is quenching between the second and third reactor, the hereinabove described control scheme may also be employed for controlling the temperature in the third reactor or any other subsequent reactor.

The above modifications and others should be apparent to those skilled in the art from the teachings herein.

The present invention is particularly advantageous in that it is possible to control the temperature during a hydrogenation reaction, without changing the flow rate of hydrogen gas and/or feed to the reactor in order to maintain a predetermined temperature in the reactor.

In addition, such a result is achieved in direct response to temperatures in the reactor.

Furthermore, such a result is achieved while also determining the inlet temperature to the reactor.

These and other advantages should be apparent to those skilled in the art from the teachings herein.

Numerous modifications and variations of the present invention are possible in light of the above teachings; accordingly, within the scope of the appended claims the invention may be practiced otherwise than as particularly described.

What is claimed is:

1. A process for hydrogenating a feed in a reactor, comprising:

heating at least one of a feed to the reactor or a gas containing hydrogen in a fuel fired furnace prior to introduction into the reactor; sensing the temperature at different height levels in the reactor; and controlling the flow rate of fuel to the fuel fired furnace in response to an average temperature in the reactor as determined from the temperatures sensed at different levels in the reactor to maintain a pre-set temperature in the reactor.

2. The process of claim 1 wherein the hydrogen gas is heated in said fuel fired furnace.

3. The process of claim 2 and further comprising:

providing a first signal representative of the average temperature in the reactor as determined by sensing the temperature at different height levels in the reactor; providing a second signal indicative of the difference between the first signal and a pre-set temperature for the reactor; providing a reactor inlet temperature set point in response to the second signal; providing a third signal indicative of the reactor inlet temperature for the feed and hydrogen; and controlling the flow rate of fuel in response to an average temperature based on a comparison between said setpoint and said third signal.

4. The process of claim 3 wherein the feed is hydrogenated in an expanded bed of catalyst in the reactor.

5. The process of claim 3, and further comprising:

providing a fourth signal indicative of the difference between the third signal and the reactor inlet temperature setpoint; providing a fuel flow rate setpoint in response to the fourth signal; and maintaining the flow rate of fuel to the fuel fired furnace so as to correspond to the fuel flow rate setpoint to thereby maintain the pre-set temperature in the reactor by controlling the flow rate of fuel.

6. In a process for hydrogenating an effluent from a previous hydrogenation reactor in a subsequent hydrogenation reactor, the improvement comprising:

quenching the effluent from the previous hydrogenation reactor with at least one quench stream, prior to introduction into the subsequent hydrogenation reactor; sensing the temperature at different height levels in the subsequent reactor; and controlling the flow rate of at least one quench stream in response to an average temperature in the subsequent reactor as determined from temperatures sensed at different levels in the subsequent reactor to maintain a pre-set temperature in the subsequent reactor.

7. The process of claim 6 wherein the at least one quench stream is a gas containing hydrogen.

8. The process of claim 7 and further comprising providing a first signal representative of the average temperature in the subsequent reactor as determined by sensing the temperature at different height levels in the subsequent reactor; providing a second signal indicative of the difference be the first signal and the pre-set temperature for the subsequent reactor; providing a subsequent reactor inlet temperature setpoint in response to the second signal; providing a third signal indicative of the temperature of the quenched effluent to be introduced into the subsequent reactor; and controlling the flow rate of at least one quench stream in response to an average temperature based on a comparison between said setpoint and said third signal.

9. The process of claim 6 wherein the at least one quench stream is a quench liquid.

10. The process of claim 9 wherein the at least one quench stream is a gas containing hydrogen.

11. The process of claim 6 wherein the effluent is quenched with a first quench stream comprising a gas containing hydrogen and a second quench stream which is a liquid quench stream; sensing the temperature at different height levels in the subsequent reactor; and controlling the flow rate of the second quench stream in response to an average temperature in the subsequent reactor as determined from temperature sensed at different levels to maintain the pre-set temperature in the subsequent reactor.

12. The process of claim 11 and further comprising:

providing a first signal representative of the average temperature in the subsequent reactor as determined by sensing the temperature at different height levels in the subsequent reactor; producing a second signal indicative of the difference between the first signal and the pre-set temperature for the subsequent reactor; providing a subsequent reactor inlet temperature setpoint in response to the second signal; providing a third signal indicative of the temperature of the quenched effluent to be introduced into the subsequent reactor; and controlling the flow rate of the second quench stream in response to an average temperature based on a comparison between said setpoint and said third signal.

13. The process of claim 6 wherein at least one of the feed to be upgraded and a gas containing hydrogen introduced into the previous hydrogenation is heated in a fuel fired furnace prior to introduction into previous hydrogenation reactor; sensing the temperature at different height levels in the reactor; and controlling the flow rate of fuel to the fuel fired furnace in response to an average temperature in the previous hydrogenation reactor as determined from temperatures sensed at different levels in the previous hydrogenation reactor to maintain a pre-set temperature in the previous hydrogenation reactor.

14. The process of claim 8, and further comprising:

providing a fourth signal indicative of the difference between the third signal and the reactor inlet temperature setpoint; providing a flow rate setpoint for the at least one quench stream in response to the fourth signal; and maintaining the flow rate of the at least one quench stream so as to correspond to the flow rate setpoint to thereby maintain the pre-set temperature in the subsequent reactor by controlling the flow rate of the at least one quench stream.

15. The process of claim 11, and further comprising:

providing a fourth signal indicative of the difference between the third signal and the subsequent reactor inlet temperature setpoint, and providing a second quench stream flow rate setpoint in response to the fourth signal; and maintaining the flow rate of the second quench stream so as to correspond to flow rate setpoint to thereby maintain said pre-set temperature in the reactor by controlling the flow rate of the second quench stream in response to the temperature of the reactor.

* * * * *